United States Patent [19]

Goetz

[11] Patent Number: 4,884,306

[45] Date of Patent: Dec. 5, 1989

[54] CLAMPING HOLDER FOR FIXING A SUPPORT ROD TO A CHILD'S BED

[76] Inventor: Kurt A. Goetz, Aumuehle Container Terminal, D-8700 Wurzburg, Fed. Rep. of Germany

[21] Appl. No.: 307,788

[22] Filed: Feb. 7, 1989

[51] Int. Cl.[4] ..... A47G 29/00

[52] U.S. Cl. ..... 5/503; 5/508; 248/225.31; 248/316.1

[58] Field of Search ..... 5/53, 507, 508, 503, 5/414; 248/225.31, 229, 231, 316.1, 316.4

[56] References Cited

U.S. PATENT DOCUMENTS

| | | | |
|---|---|---|---|
| 884,772 | 4/1908 | Sorensen | 248/225.31 |
| 1,204,734 | 11/1916 | Benson | 248/229 |
| 1,806,773 | 5/1931 | Waters | 5/508 |
| 2,678,792 | 5/1954 | Gallion | 248/225.31 |
| 3,286,283 | 11/1966 | Bertoldo | 5/503 |
| 4,593,422 | 6/1986 | Wolpert | 5/503 |

*Primary Examiner*—Gary L. Smith
*Assistant Examiner*—F. Saether
*Attorney, Agent, or Firm*—Arnold, White & Durkee

[57] ABSTRACT

A clamping holder for fixing a support rod to the headboard of a child's bed is disclosed. The clamping holder is a simple, easy to manufacture device which securely anchors the support rod while distributing the clamping forces over an area sufficient to avoid distortion or marring of the headboard.

8 Claims, 2 Drawing Sheets

CLAMPING HOLDER FOR FIXING A SUPPORT ROD TO A CHILD'S BED

BACKGROUND OF THE INVENTION

It is often desirable to attach a fixture, such as a bed canopy, above a child's bed. Until now, such fixtures have been clamped to the headboard of a child's bed in such a way that the tubular support rod was pressed directly onto the wood of the headboard of the bed. Furthermore, this method exhibited deficiencies with respect to the manner of fixing to the headboard. Hereby the headboard of the bed was correspondingly impressed upon, and damage could also occur, depending on the material.

SUMMARY OF THE INVENTION

This clamping holder invention has a clamping piece which is arranged between the side pieces of a U-shaped holding piece and has a hole to receive the support rod, which also reaches through an oblong hole in the web area between the side pieces of the U-shaped holding piece. The clamping screw is screwed through one side piece and grips the support rod through an opening showing towards it in the side of the clamping piece, so that when the screw is adjusted in the longitudinal axis by the screwing action, the support rod, and thus the clamping piece, is moved towards the inside surface of the other side piece by a larger or smaller distance. As the clamping piece has a broad surface that is approximately parallel to, and facing the inside surface of, the other side piece, a gap of variable width is formed between this broad surface and the inner surface of the other side piece; into this gap and edge part of the headboard of the child's bed is inserted. By turning the clamping screw, it is thus possible to clamp the edge part of the headboard of the child's bed between the broad surface of the clamping piece, and the inner surface of the other side piece, whereby the support rod or canopy is clamped and held as intended on the child's bed.

With the clamping piece according to this invention, one thus achieves distribution of the clamping forces acting on the headboard of the child's bed over a large area, so that no indentations are made and so that repeated mounting and dismounting of the canopy on the bed will not damage or leave unsightly indentation marks on the headboard.

The design of the clamping holder according to this invention allows fixing of the support rod and also a large-area clamping action on the headboard of the bed with one clamping screw. This considerably simplifies manufacturing effort and handling.

Since in the preassembled condition, the tubular support rod reaches through both the clamping piece, through its hole, and through the U-shaped holding piece, through its oblong hole, no alignment problems are encountered in this respect. After inserting the freely projecting end of the screw shank of the clamping screw into the corresponding opening located on the side of the clamping piece, the broad surface of the clamping piece can also be safely aligned parallel to the inner surface of the other side piece, because the clamping holder with support rod can be easily placed against the top or bottom edge part of the headboard of the child's bed, after which the support rod can be clamped tightly to the headboard of the bed by appropriate turning the clamping screw using its hand knob. As a rule, two such clamping holders are used for this purpose; namely, one for the top and one for the bottom edge part of this headboard.

Preassembly can be facilitated to a certain extent by providing on the side of the clamping piece that faces the web area of the holding piece a guide projection which engages in the oblong hole. The hole is then of correspondingly larger size. Hereby the position of the clamping piece to the U-shaped holding piece is already adjusted to a certain degree before the support rod is inserted. If one ensures that this guide projection is provided with two straight outside sections that are parallel to each other and which slide and act on the longitudinal sides of the oblong hole, one also obtains alignment of the clamping piece to the clamping screw during preassembly, which necessarily determines the alignment of the threaded shank to the opening of the clamping piece.

DETAILED DESCRIPTION OF THE INVENTION

Figure 1:
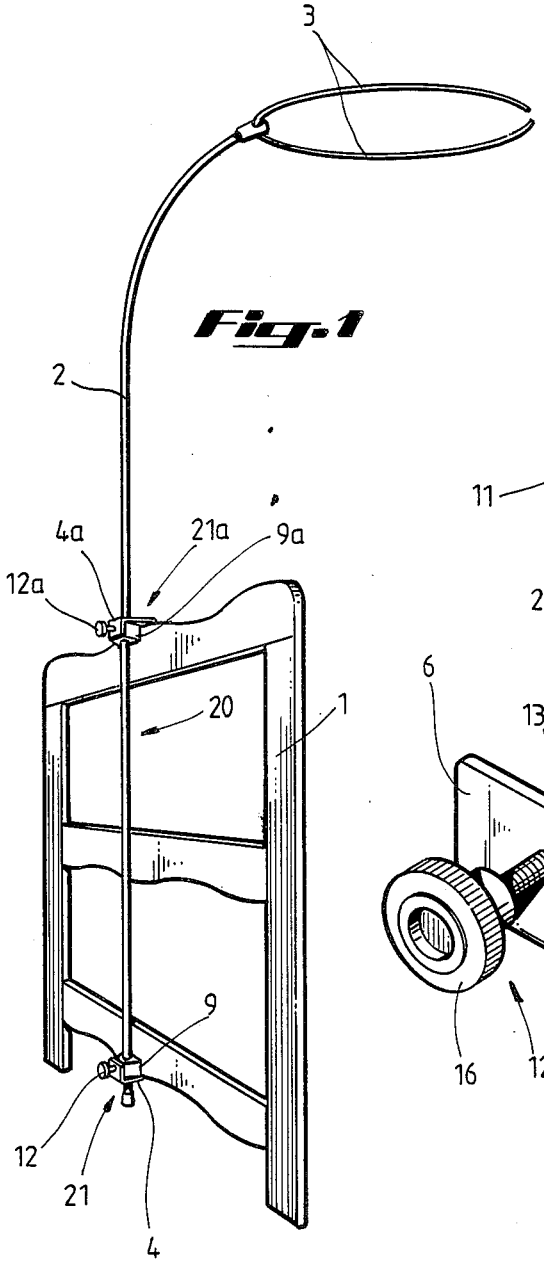
FIG. 1 is a perspective view of a headboard of a child's bed with a canopy holder clamped to the headboard at its upper and lower edges.

Refer first to FIG. 1. A child's bed headboard 1 is shown with a bed canopy support frame 3 supported above the bed by two clamping holders 4, 4*a* used to attach a support rod 2. The components 2, 4, 4*a*, 9, 9*a*, 12, 12*a* form a clamping fixture 20 which supports the bed canopy support frame 3 over the bed (not shown). It can be seen by one skilled in this art that other devices such as mobiles or toys could replace the bed canopy support frame 3 and be supported over the bed by this invention.

Figure 2:
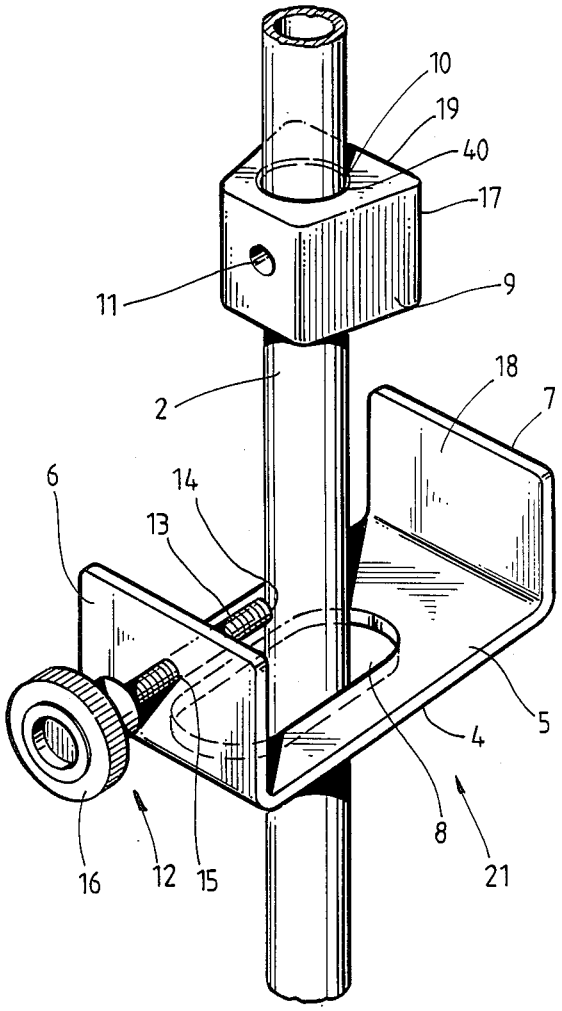
FIG. 2 is an enlarged exploded perspective view of the lower portion of the clamping holder shown in FIG. 1.

By now referring to FIG. 2, one can see and understand the components which make up the lower portion of the clamping fixture 20. The lower clamping holder 21 of the assembly shown in FIG. 1 is comprised of threaded screw 12, holding piece 4, and clamping piece 9. The upper clamping holder 21*a* is shown in enlarged detail in FIG. 3. It is comprised of clamping screw 12*a*, holding piece 4*a*, and clamping piece 9*a*, and may be identical to lower clamping holder 21. For this reason, only lower clamping holder 21 will be described in detail below.

The clamping holder 21 consists of a U-shaped holding piece 4 consisting of a web area 5 and two side pieces 6 and 7. In the web area 5, connecting the two side pieces of the U-shaped holder piece 4, an oblong hole 8 is provided, through which passes the support rod 2.

The support rod 2 reaches through a clamping piece 9 which has a hole 10 for this purpose. The size of this hole 10 is such that the support rod 2 slides through.

The clamping piece 9 seen in the direction of the support rod 2 has a trapezoidal contour—in this case a trapezoidal cross section. In the smaller of the two parallel base walls of this trapezoidal contour is an opening 11 whose longitudinal axis is approximately at right angles to that of the hole 10.

A clamping screw, designated 12 in its entirety, has a threaded shank 13 and a freely projecting threaded end 14, and can be screwed through a threaded hole 15 provided in the side piece 6 of the U-shaped holding piece 4. The clamping screw has threaded shank 13 with a projecting end 14 which extends into the space between the side pieces 6 and 7 of the holding piece 4 and has a hand knob 16 on its opposite end.

During preassembly, the support rod 2 is passed through the hole 10 of the clamping piece 9 and the oblong hole 8 of the U-shaped holding piece 4, as shown. Then the clamping piece 9 is lowered onto the web area 5 of the holding piece 4 and aligned in such a way that the end 14 of the threaded shank 13 can engage into the opening 11 of the clamping piece 9.

The clamping piece 9 has on its side opposite the opening 11 a broad surface 17 whose approximately horizontal edge 19 is the larger of the two parallel sides of the trapezoidal cross section of the clamping piece 9.

After the holding piece 4 and the clamping piece 9 have been mounted on the support rod 2, the lower edge part of the headboard 1 of the child's bed is inserted into the gap formed by the broad surface 17 of the clamping piece 9 and by the inner surface 18 of the other side piece 7 of the U-shaped holding piece 4. The gap can be adjusted to accommodate the headboard by turning the clamping screw 12. The clamping screw 12 is screwed such that the clamping piece 9 is moved towards the side piece 7 of the holding piece 4, and during this movement holds and arrests the lower edge part of the headboard 1 of the child's bed. Correspondingly, upper clamping holder **21*a* is mounted on the upper edge of the headboard 1 as shown in FIG. 1**.

This arresting is accomplished by means of the clamping screw 12, which reaches through the continuous opening 11, via pressure on the support rod 2, which in turn moves the clamping piece 9 towards the side piece 7 via the outer wall 40 of the hole 10. Accordingly, in the clamped condition, the support rod 2 is fixed in its respective position in the holding piece 4 by means of the clamping screw 12 and at the same time the respective edge part of the headboard 1 of the child's bed is located and clamped between the broad surface 17 of the clamping piece 9 and the inner surface 18 of the other side piece 7 of the holding piece 4 so that as a whole the support rod 2 is clamped on the headboard 1 and held in a fixed position.

As discussed above, FIG. 3 depicts the upper clamping holder **21*a* shown in FIG. 1. The upper clamping holder 21*a* may be and usually is identical to the lower clamping holder 21. To illustrate the similarities, all of the components of upper clamping holder 21*a* are numbered the same as the components of lower clamping holder 21**, except that each upper clamping holder number is followed by an "a".

Figure 3:
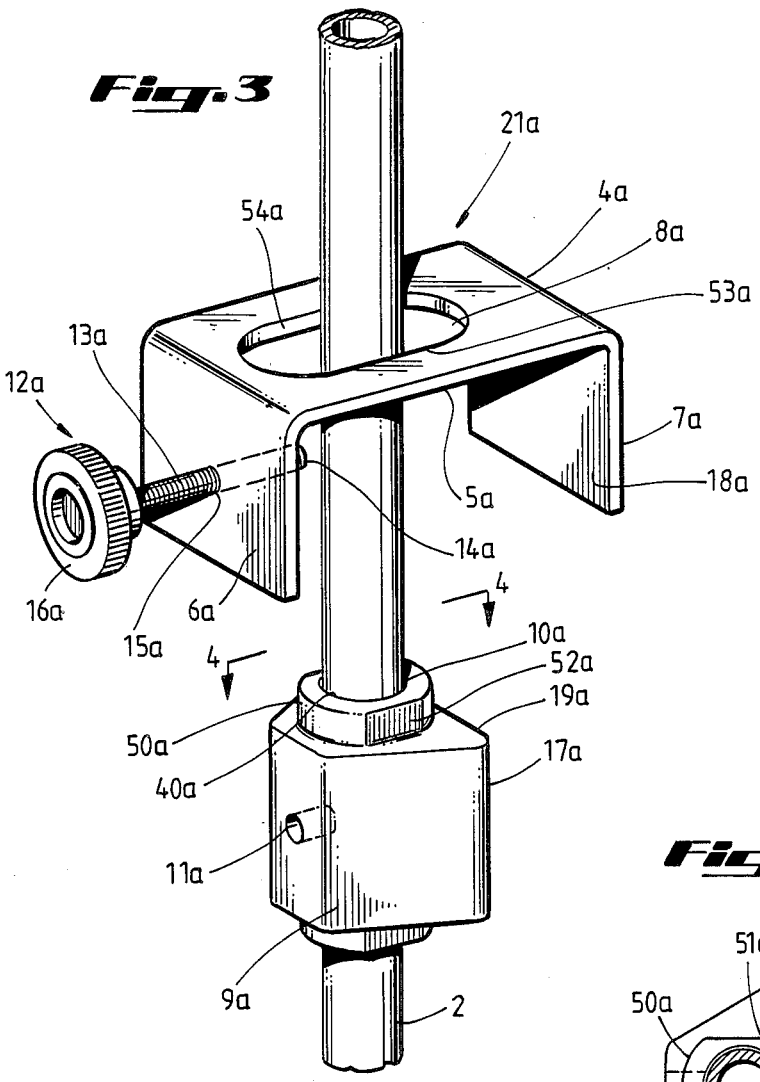
FIG. 3 is an enlarged exploded perspective view of the upper portion of the clamping holder shown in FIG. 1 showing additional optional features.

FIG. 3 actually depicts an embodiment of upper clamping holder **21*a* which has an additional optional feature. It is important to note that the optional features shown in FIG. 3 can be incorporated in either the upper clamping holder 21*a* or the lower clamping holder 21** or both.

The clamping holder **21*a* depicted in FIG. 3 includes a guide projection 49*a* in the shape of a collar 50*a* around the hole 10*a* in clamping piece 9*a*. The projection 49*a* has two parallel straight outside sections 51*a* and 52*a*. Upon assembly of clamping holder 21*a*, which is otherwise the same as the assembly of clamping holder 21 described previously, the guide projection 49*a* engages the oblong hole 8*a* to locate clamping piece 9*a* with respect to U-shaped holding piece 4*a*. Clamping piece 9*a* by utilizing the guide projection 49*a* can be easily aligned with the U-shaped clamping piece 4*a* before insertion of support rod 2. The parallel straight outside sections 51*a* and 52*a* slidably mate with corresponding longitudinal sides 53*a* and 54*a* of the oblong hole 8*a*. This orients the clamping piece 9*a* so that opening 11*a* is aligned with the end 14 and threaded shank 13*a* of clamping screw 12*a***.

Figure 4:
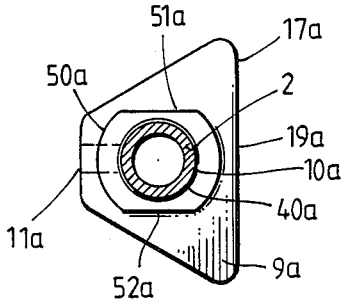
FIG. 4 is a sectional view of the clamping holder shown in FIG. 3.

FIG. 4 is a sectional view showing a preferred shape of clamping piece **9*a* and guide projection 50*a*, the orientation of straight outside section 51*a* and 52*a* relative to opening 11*a*, and the location of support rod 2 with respect to hole 10*a***.

It should be understood that the foregoing description of the invention is intended merely to be illustrative thereof and that the invention is not confined to the construction and arrangements of parts herein illustrated and described, but embraces all such modified forms thereof as come within the scope of the following claims.

What is claimed is:

1. A clamping fixture for fixing a bed canopy or the like to the headboard of a bed or the like, comprising:

a U-shaped holding piece having a first side piece having an inner surface and a lower end, a second side piece having a threaded hole therethrough and a lower end, a web area connecting the lower end of the first side piece to the lower end of the second side piece, the web area having an oblong hole therethrough;

a clamping piece having a clamping surface a bottom surface perpendicular to the clamping surface and in sliding contact with the web area of the U-shaped holding piece, a hole therethrough with an axis parallel to the clamping surface and perpendicular to the bottom surface, a back surface parallel to the clamping surface;

a support rod extending through the hole in the clamping piece and the oblong hole in the holding piece; and, a means for urging the support rod and the clamping piece towards the first side piece to thereby clamp the headboard between the clamping surface and the inner surface and restrain the support rod.

2. A clamping fixture for fixing a bed canopy to the headboard of a bed, comprising:

a U-shaped holding piece having a first side piece having an inner surface and a lower end, a second side piece having a threaded hole therethrough and a lower end, a web area connecting the lower end of the second side piece, the web area having an oblong hole therethrough;

a clamping piece having a substantially planar clamping surface parallel to the inner surface of the first side piece, a substantially planar bottom surface perpendicular to the clamping surface and in sliding contact with the web area of the U-shaped holding piece, a hole therethrough with an axis parallel to the clamping surface and perpendicular to the bottom surface, a back surface parallel to the clamping surface and opening from the back surface to the hole;

a support rod extending through the hole in the clamping piece and the oblong hole in the holding piece; and, a threaded screw having a hand knob, a threaded shank, and a projecting end, the screw being threaded through the hole in the second side piece such that turning the screw in one direction extends the projecting end through the opening in the clamping piece to contact the support rod and thereby urge the clamping surface toward the inner surface to clamp the headboard therebetween and restrain the support rod thereon.

3. A clamping holder as described in claim 1 or 2, which clamps the support rod to the headboard in two places by utilizing two U-shaped holding pieces, two clamping pieces, and two threaded screws.

4. The clamping holder of claim 1 or 2, wherein the clamping piece has a guide projection that engages the oblong hole.

5. The clamping holder according to claim 4, wherein the guide projection is shaped like a collar around the hole in the clamping piece.

6. The clamping holder according to claim 4, wherein the guide projection has two parallel outside surfaces that act on longitudinal sides of the oblong hole.

7. The clamping holder of claim 1 or 2, wherein the clamping piece has a trapezoidal cross section in the plane perpendicular to the longitudinal axis of the support rod.

8. The clamping holder of claim 1 or 2, wherein the clamping piece is plastic.

* * * * *

UNITED STATES PATENT AND TRADEMARK OFFICE

CERTIFICATE OF CORRECTION

PATENT NO. : 4,884,306

DATED : December 5, 1989

INVENTOR(S) : Kurt A. Goetz

It is certified that error appears in the above—identified patent and that said Letters Patent is hereby corrected as shown below:

On the front page, add:

-- Foreign Application Priority Data

February 29, 1988 Fed. Repub. of Germany G 88 02 658.2 --

Column 1, line 34, "and edge" should be -- an edge --.

Column 1, line 67, "appropriate" should be -- appropriately --.

Column 4, line 16, "outside section" should be -- outside sections --.

Column 4, line 36 (line 10 of claim 1), insert a comma (,) after "clamping surface".

Signed and Sealed this

Eighteenth Day of December, 1990

*Attest:*

HARRY F. MANBECK, JR.

*Attesting Officer*

*Commissioner of Patents and Trademarks*